United States Patent [19]

Chang et al.

[11] Patent Number: 4,472,107

[45] Date of Patent: Sep. 18, 1984

[54] ROTARY FLUID HANDLING MACHINE HAVING REDUCED FLUID LEAKAGE

[75] Inventors: Ching M. Chang; Ross H. Sentz, both of Williamsville, N.Y.

[73] Assignee: Union Carbide Corporation, Danbury, Conn.

[21] Appl. No.: 404,761

[22] Filed: Aug. 3, 1982

[51] Int. Cl.[3] ..... F01D 3/00

[52] U.S. Cl. ..... 415/104; 415/170 R; 415/169 A

[58] Field of Search ..... 415/104, 105, 106, 107, 415/109, 140, 170 R, 175, 131, 99, 14, 113, 118

[56] References Cited

U.S. PATENT DOCUMENTS

| | | | |
|---|---|---|---|
| 2,429,681 | 10/1947 | Griffith | 230/132 |
| 3,547,606 | 12/1970 | Swearingen | 48/191 |
| 3,671,137 | 6/1972 | Ball | 415/104 |
| 3,728,857 | 4/1973 | Nichols | 415/169 A |
| 3,746,461 | 7/1973 | Yokota et al. | 415/104 |
| 3,828,610 | 8/1974 | Swearingen | 73/140 |
| 3,895,689 | 7/1975 | Swearingen | 415/104 |

*Primary Examiner*—Stephen Marcus
*Assistant Examiner*—John Kwon
*Attorney, Agent, or Firm*—Stanley Ktorides

[57] ABSTRACT

A rotary fluid handling machine having reduced fluid leakage through the back annular seal of a shaft-mounted wheel which exhibits essentially a zero net axial thrust force on the thrust bearing.

11 Claims, 2 Drawing Figures

ROTARY FLUID HANDLING MACHINE HAVING REDUCED FLUID LEAKAGE

TECHNICAL FIELD

This invention relates generally to the field of rotary fluid handling machinery and more particularly to rotary fluid handling machinery employing a wheel mounted on a rotatable shaft positioned within a stationary housing.

BACKGROUND OF THE INVENTION

Rotary fluid handling machinery such as pumps, centrifugal compressors, radial in-flow expansion turbines and unitary expander-driven compressor assemblies generally employ a wheel mounted on a rotatable shaft positioned within a stationary housing. The wheel is generally composed of a plurality of curved flow paths establishing flow communication between essentially radially directed and axially directed openings. A working fluid, such as gas at high pressure, is caused to pass through these curved flow paths and, as it so passes through, energy is transferred, such as by expansion of gas, from the working fluid to the wheel which is caused to rotate thereby rotating the shaft and transferring the energy to a point of use.

One problem encountered in the use of such rotary machinery is the loss of working fluid before its energy can be transferred to the wheel. Such loss could be, for example, high pressure gas leakage between the front and back sides of the wheel and the stationary housing. Working fluid which is so lost does not pass through the curved flow paths and thus there is experienced an inefficiency in the operation of the rotary machinery.

In order to reduce this high pressure fluid loss, rotary fluid handling machinery is often equipped with annular seals on the back and on the front of a shrouded wheel. The back and front annular seals are generally an equal radial distance from the shaft so that the high pressure working fluid sealed by these seals exerts its force over equivalent areas in opposing directions on the back and front of the wheel. In this way net thrust forces on the shaft caused by the sealed high pressure working fluid are minimized. The front annular seal is generally positioned between the wheel and housing at essentially the eye diameter of the wheel and as mentioned, the back annular seal is at the same or nearly the same radial distance from the shaft as is the front annular seal.

Some rotary fluid handling machinery are not equipped with a front annular seal. In this case there will always be generated some net thrust force on the shaft due to the unbalance of forces on the wheel by the fluid. This thrust force is handled by thrust bearings which oppose the thrust force and keep the shaft axially aligned. In order to minimize the force on the thrust bearings, the back annular seal is positioned at as great a radial distance from the shaft as is practicable. This minimizes the pressure differential between the back and front of the wheel and thus minimizes the thrust forces generated by this pressure differential.

A problem of rotary fluid handling machinery is the loss of working fluid by leakage through the annular seals. One way to reduce this leakage is to position the seals as close to the shaft in a radial direction as possible. As is well known the closer is the annular seal to the shaft, the lesser is the area available for working fluid leakage and thus the lesser is the leakage flow rate experienced. However, the position of the front annular seal is essentially fixed at about the eye diameter since this is the only practical position for the front seal to be effective. Positioning the back annular seal at a radial distance from the shaft less then the radial distance of the front seal in order to reduce working fluid leakage through the back seal will result in a pressure difference, precipitating the net thrust force problem described earlier. One way to address such a problem is to design the thrust bearings to undertake a very high load. However this is costly and also difficult to accomplish.

It is therefore an object of this invention to provide an improved rotary fluid handling apparatus.

It is another object of this invention to provide an improved rotary fluid handling apparatus wherein fluid leakage past the back annular seal is minimized.

It is another object of this invention to provide an improved rotary fluid handling apparatus wherein fluid leakage past the back annular seal is minimized while avoiding the generation of large net thrust forces.

It is yet another object of this invention to provide an improved rotary fluid handling apparatus wherein the net thrust force on the thrust bearings is essentially zero.

SUMMARY OF THE INVENTION

The above and other objects which will become apparent to one skilled in this art are achieved by:

A rotary working fluid handling apparatus for processing working fluid between a high pressure and a low pressure comprising:

(A) a stationary housing;

(B) a rotor comprising (i) a shaft axially aligned for rotation within said stationary housing, (ii) at least one wheel mounted on said shaft, said wheel having a plurality of flow paths establishing flow communication between essentially radially directed and axially directed openings, and (iii) an annular seal for preventing working fluid from leaking past the back of said wheel positioned at a lesser radial distance from said shaft than the greatest radial distance from said shaft of said axially directed openings;

(C) at least one thrust bearing capable of transmitting an axial thrust load between said rotor and said stationary housing;

(D) means for determining said axial thrust load;

(E) a balancing chamber defined by said rotor and said stationary housing; and (F) fluid flow conduit means connected at one end to said balancing chamber and at the other end through valve means to at least one pressure source at a pressure at least equal to said high pressure and to at least one pressure sink at a pressure at most equal to said low pressure, said valve means being responsive to said axial thrust load determining means, whereby the net axial thrust load on said thrust bearing is essentially zero.

The term, "annular seal", is used in the present application and claims to mean a means for impeding fluid leakage between a rapidly rotating element and a stationary element. In the present invention, the annular seal is formed between a circumferential surface on the rotor and an opposing parallelly spaced surface of the housing. Generally, the seal is of the labyrinth type wherein a series of closely spaced knife-life ridges are provided in one of the opposing surfaces The term, "wheel", is used in the present application and claims to mean a centrifugal impeller having multiple flow passages for converting between pressure, i.e., static energy and kinetic, i.e., dynamic energy through the use of rotary motion. For example, in the case of pumps, compressors and the like, kinetic energy is converted into pressure energy, while in rotary machines such as turbines, the transformation is reversed.

The term, "balancing chamber", is used in the present application and claims to mean a space enclosed by a radially extending surface of the rotor and appropriate surfaces of the stationary housing in which a proper fluid pressure can be established for producing a force which is used to balance other forces acting on the rotor.

DETAILED DESCRIPTION

Figure 1:
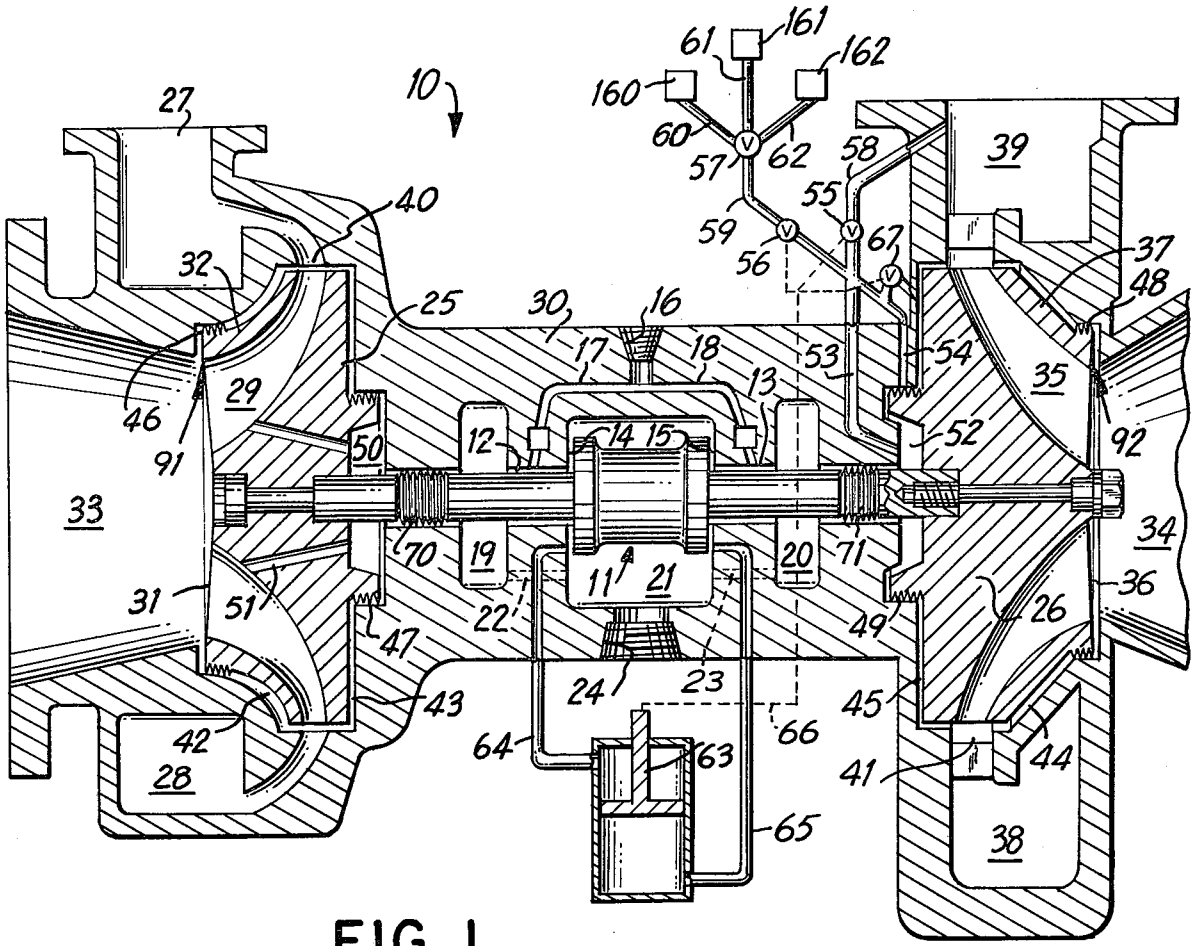
FIG. 1 is a partial cross-sectional view of one preferred embodiment of the rotary fluid handling apparatus of this invention wherein the rotary apparatus is a unitary expander-driven compressor.

The rotary working fluid handling apparatus of this invention will be described in detail with reference to FIG. 1 wherein there is shown a unitary expander-driven compressor assembly 10. Shaft 11 is rotatably mounted in journal bearings 12 and 13 and is axially positioned by thrust bearings 14 and 15 within stationary housing 30. The bearings are lubricated by lubrication fluid drawn from a reservoir and delivered to inlet 16 from which it is passed through conduits 17 and 18 and into journal bearings 12 and 13 and thrust bearings 14 and 15 through appropriately sized feed orifices. The lubricant flows axially and radially through the journal and thrust bearings, lubricating the bearings and supporting the shaft against both radial and axial perturbations. Lubricant discharged from journal bearings 12 and 13 flows into annular recesses 19 and 20 respectively. The lubricant then flows into main lubricant collection chamber 21 through drain conduits 22 and 23 where it mixes with lubricant discharged from thrust bearings 14 and 15. Lubricant is then removed from chamber 21 and through the lubricant outlet drain 24.

A turbine wheel or impeller 25 and a compressor wheel or impeller 26 are mounted on the opposite ends of shaft 11 within stationary housing 30. Each wheel is composed of a number of curved passages through which the working fluid flows while passing from one of either high or low pressure to the other pressure. The passages are essentially radially directed at the high pressure end of the passages and axially directed at the low pressure end.

High pressure working fluid to be expanded is introduced radially into turbine wheel 25 through turbine inlet 27 and turbine volute 28. This fluid then passes through the turbine wheel passages 29, which are formed by blades 31 extending between wheel 25 and annular shroud 32, and exits the turbine in an axial direction into turbine exit diffuser 33. As the high pressure working fluid expands through the turbine wheel 25, it turns shaft 11 which in turn drives some type of power-consuming device, in this case, compressor wheel 26.

Rotation of the compressor wheel 26 by the expanding working fluid passing through turbine wheel 25 draws fluid in through compressor suction or inlet 34. This fluid is pressurized as it flows through compressor passages 35, which are formed by blades 36 extending between wheel 26 and the annular shroud 37, and is discharged through compressor diffuser 41, volute 38 and compressor diffuser discharge 39.

Front turbine wheel annular seal 46 and front compressor wheel annular seal 48 are positioned at essentially the eye diameter of the wheel. The eye diameter of a wheel is the distance across the front or face of the wheel. The prevailing pressures at the inlet 40 of turbine wheel 25 and the inlet of diffuser 41 of compressor wheel 26 are communicated to the front and back spaces of each of turbine wheel and compressor wheel spaces 42,43,44, and 45 respectively. Front and back annular seals 46 and 47 respectively of turbine wheel 25, and 48 and 49 respectively of compressor wheel 26 restrict the quantity of working fluid that leaks around the front and the back of the wheel bypassing flow passages 29 and 31 of the turbine and compressor wheels respectively.

In order to reduce the leakage of working fluid through back annular seal 47, this seal is positioned radially closer to the shaft than is positioned front annular seal 46. As can be appreciated the closer to the shaft that back annular seal 47 is positioned the smaller is the annular cross-sectional area through which the leakage fluid may flow. For a similar seal design, the smaller is the seal area the lesser is the fluid leakage through the seal and the greater is the efficiency of the rotary fluid handling machinery. Although most rotary fluid handling machinery will employ front annular seals, some types, especially those that do not employ an annular shroud may not employ front annular seals. Therefore the position of the back annular seal can be more completely defined as being at a lesser radial distance from the shaft than the greatest radial distance from the shaft of the axially directed openings which distance is defined by point 91 for turbine wheel 25 axially directed openings 29. In the embodiment of FIG. 1 back annular seal 49 of compressor wheel 26 is also shown to be at a lesser radial distance from the shaft than the greatest radial distance from the shaft at point 92, of axially directed openings 35. Although this is a preferred arrangement when more than one wheel is employed on the shaft, it is not required, and, it is necessary only that one wheel on the shaft employ the back annular seal positioning defined by this invention.

The FIG. 1 embodiment illustrates an arrangement wherein the back annular seals 47 and 49 comprise annular rings aligned parallel to shaft 11 and extending from the back of wheels 25 and 26 respectively. Another arrangement could have the back annular seal oriented orthogonal to the shaft along the back of the wheel. In yet another arrangement, the back annular seal would not be contiguous with the wheel as it is in the previously described arrangements. Instead, for example, the back annular seal may be positioned on the shaft, such as seals 70 and 71 in the FIG. 1 embodiment.

Because back annular seal 47 is positioned radially closer to shaft 11 than is front annular seal 46, the projected area of the wheel in front of space 43 is greater than the projected area of the wheel in front of space 42. When high pressure working fluid fills these spaces there is a net outward axial force imposed on the wheel. The direction of this outward axial force is to the left in the FIG. 1 embodiment. The magnitude of this axial force depends on the relative radial position of seal 47 compared to seal 46 and whether or not chamber 50 is vented to the low pressure side of the wheel, such as for example through passages 51.

The axial force generated by the positioning of the back annular seal in accord with the apparatus of this invention causes the shaft to move axially thus exerting a pressure change in the lubricant in the thrust bearing. A pressure determining means senses this pressure change and actuates valve means to vary the pressure in a balancing chamber so as to exert an opposing force on the rotor resulting in a net axial force on the thrust bearing of essentially zero. As recognized in the art the term rotor is used to describe the entire rotary element including the shaft and any other appurtenances such as turbine, pump or compressor wheels.

Referring back to FIG. 1 which illustrates an embodiment wherein a pair of thrust bearings are employed, it is seen that a pressure increase in thrust bearing 14 will be accompanied by a pressure decrease in thrust bearing 15, and vice versa. The pressure determining means illustrated in FIG. 1 comprises fluid filled conduits 64 and 65 connected to thrust bearings 14 and 15 respectively and directed to opposite sides of piston 63. As the pressure in the thrust bearings changes as a consequence of changing thrust loads, the postion of piston 63 will automatically readjust. This change in position is communicated through line 66 by either mechanical, electrical or hydraulic means to valve 55 for controlling the pressure in balancing chamber 52.

Balancing chamber 52 is defined by stationary housing 30 and compressor wheel 26. The pressure in balancing chamber 52 is modulated so as to offset any net axial thrust loads acting on shaft 11. This is accomplished by connecting balancing chamber 52 by conduit 53 through valve 55 and conduit 58 to a pressure source at a pressure at least equal to the high pressure of the working fluid; in this case the pressure source is compressor diffuser discharge 39. Also balancing chamber 52 is connected through a portion of the labyrinth seal 49 with an appropriate amount of flow resistance by conduit 54 through valve 56, conduit 59, and valve 57 through conduits 60, 61 and 62 to pressure sinks 160, 161 and 162, respectively. The pressure sinks are schematically represented in FIG. 1 and they may be any appropriate pressure sinks including a vent to the atmosphere. The pressure sinks are each at a different pressure and at least one pressure sink is at a pressure at most equal to the low pressure of the working fluid. The operation of valve 56 is controlled by differential pressure cell 67 which insures that the pressure in conduit 54 remains below a predetermined value, such as for example, 10 psi below the pressure at the inlet of compressor diffuser 41. In this way no radial outward flow of fluid can occur through space 45.

When the apparatus of FIG. 1 experiences a net thrust force acting on the rotor directed to the right in FIG. 1, there will be an increase in the lubricant pressure in thrust bearing 15 relative to the lubricant pressure in thrust bearing 14. This pressure differential will cause piston 63 to move upwardly transmitting an appropriate signal via line 66 to the valve assembly 55, 56 and 67. Valve 56 will be opened thereby exposing the balancing chamber 52 to one of the pressure sinks via valve 57. In this way, the pressure in chamber 52 is reduced to yield a net thrust force acting on compressor wheel 26 that is equal and opposite to the original net axial thrust load developed so that the rotor is operating under a zero thrust load.

When the apparatus of FIG. 1 experiences a net thrust force acting on the rotor directed to the left in FIG. 1, there will be an increase in the lubricant pressure in thrust bearing 14 relative to the lubricant pressure in thrust bearing 15. This pressure differential will cause piston 63 to move downwardly transmitting an appropriate signal via line 66 to the valve assembly 55, 56 and 67. Valve 55 will be opened thereby establishing an appropriate pressure in chamber 52 to yield a net thrust force acting on compressor wheel 26 that is equal and opposite to the original net axial thrust load developed so that the rotor is operating under a zero net thrust load.

Heretofore rotary fluid handling machinery had to employ the back annular seal positioned at a large radial distance from the shaft and at about the same radial distance as the front annular seal if one were used. This results in a significant loss of working fluid by leakage through the back annular seal. Now by the use of the apparatus of this invention one can reduce working fluid loss through the back annular seal without increasing the axial thrust load which must be supported by the thrust bearing. Although thrust bearing load compensation systems are known, all heretofore such systems can compensate the load in the bearing only to a limited extent and only in the direction of axial thrust caused by working fluid pressure on the eye of the wheel. The rotary fluid handling apparatus of this invention can compensate for a wide range of pressure from below the working fluid low pressure to above the working fluid high pressure and also in any direction of axial thrust.

In the FIG. 1 embodiment, balancing chamber 52 is positioned behind compressor wheel 26. However the balancing chamber can be positioned in any convenient location defined by the rotor and the stationary housing in order to apply a pressure on the rotor to compensate for the axial thrust load on the bearing. For example, the balancing chamber could be positioned behind the turbine wheel. Also, the balancing chamber could be associated with a separate balancing disc attached to the shaft.

Figure 2:
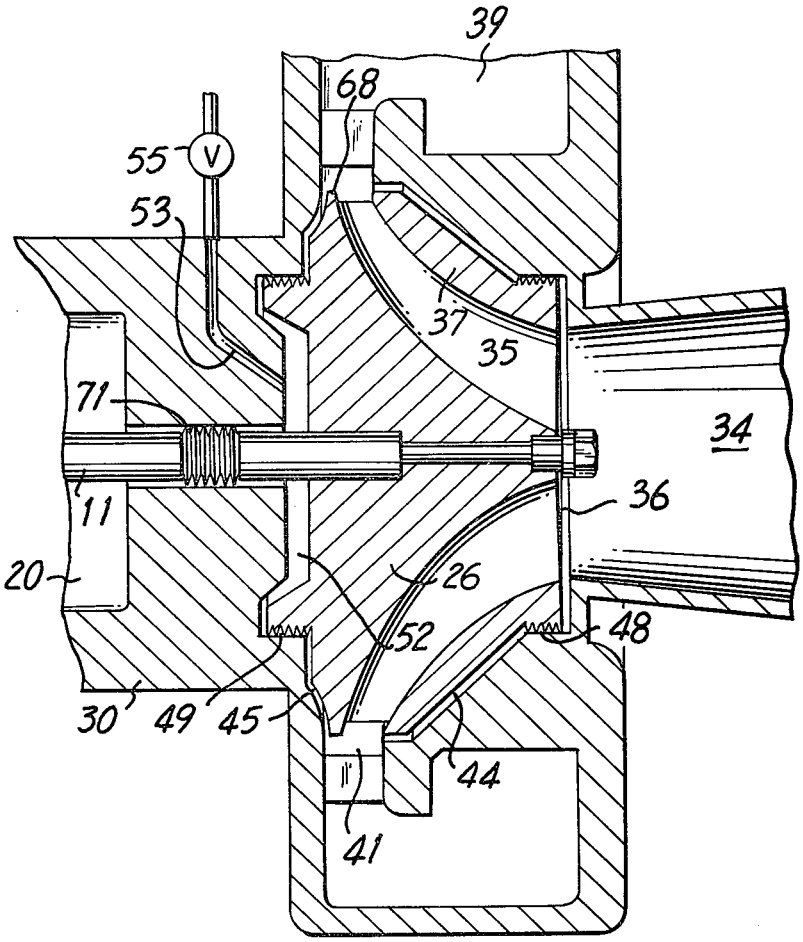
FIG. 2 is a partial cross-sectional view of another embodiment of the balancing chamber pressure control arrangement associated with the rotary fluid handling apparatus of this invention.

FIG. 2 illustrates an alternative design for the balancing chamber pressure control. The numerals in FIG. 2 correspond to those of FIG. 1 for the elements common to both. FIG. 2 illustrates a compressor wheel and can be thought of as another embodiment of the right hand side of FIG. 1. As can be seen the back annular seal is positioned at what may be termed the conventional position, i.e., at about the same radial distance from the shaft as the front annular seal and greater than the greatest radial distance from the shaft than the axially directed openings. Although the rotary fluid handling apparatus of this invention can have more than one wheel, only one of the wheels need have the back annular seal positioned closer to the shaft than the greatest radial extent from the shaft of the axially directed openings.

Referring now to FIG. 2, radial outermost end 68 of compressor wheel 26 is shaped so that any radial outflow of fluid will be introduced substantially tangentially into the compressor discharge fluid. In this way the need for conduit 54 of FIG. 1 is eliminated. Instead, a single conduit 53 communicating with the pressure balancing chamber 52 can be employed to vary the pressure in balancing chamber 52. When the pressure in balancing chamber 52 is greater than the static pressure at the inlet of compressor diffuser 41, the net outward flow of fluid does not seriously impair the operating efficiency of compressor 26 since this fluid is tangentially directed into the outward flow of gas.

Although the rotary fluid handling apparatus of this invention has been described in detail with reference to a particular embodiment, it is understood that there are many more embodiments of this invention within the spirit and scope of the claims.

We claim:

1. A rotary working fluid handling apparatus for processing working fluid between a high pressure and a low pressure comprising:

(A) a stationary housing;

(B) a rotor comprising (i) a shaft axially aligned for rotation within said stationary housing, (ii) at least one wheel mounted on said shaft, said wheel having a plurality of flow paths establishing flow communication between essentially radially directed and axially directed openings, and (iii) an annular seal for preventing working fluid from leaking past the back of said wheel positioned at a lesser radial distance from said shaft than the greatest radial distance from said shaft of said axially directed openings;

(C) at least one thrust bearing capable of transmitting an axial thrust load between said rotor and said stationary housing;

(D) means for determining said axial thrust load;

(E) a balancing chamber sealed from the bearing defined by said rotor and said stationary housing; and (F) fluid flow conduit means connected at one end of said balancing chamber and at the other end through valve means to at least one pressure source at a pressure at least equal to said high pressure and to at least one pressure sink at a pressure at most equal to said low pressure, said valve means being responsive to said axial thrust load determining means, whereby the net axial thrust load on said thrust bearing is essentially zero.

2. The apparatus of claim 1 wherein said annular seal is contiguous with said wheel and aligned parallel to said shaft.

3. The apparatus of claim 1 wherein said annular seal is contiguous with said wheel and aligned orthogonal to said shaft.

4. The apparatus of claim 1 wherein said annular seal is contiguous with said shaft.

5. The apparatus of claim 1 wherein said wheel is a turbine wheel.

6. The apparatus of claim 5 wherein a compressor wheel is mounted on said shaft on the end opposite said turbine wheel.

7. The apparatus of claim 6 wherein said balancing chamber is defined by said stationary housing and said compressor wheel.

8. The apparatus of claim 1 having a second thrust bearing capable of transmitting an axial thrust load between said rotor and said stationary housing in a direction opposite the direction of the axial thrust load on the first thrust bearing.

9. The apparatus of claim 1 wherein said means for determining axial thrust load is a pressure activated piston.

10. The apparatus of claim 1 wherein said pressure source is at a pressure greater than said high pressure.

11. The apparatus of claim 1 wherein said pressure sink is at a pressure less than said low pressure.

* * * * *